US005110229A

United States Patent [19]

Ide

[11] Patent Number: 5,110,229

[45] Date of Patent: May 5, 1992

[54] PRINTING DEVICE HAVING A RIBBON CASSETTE WITH A END OF RIBBON SENSOR

[75] Inventor: Takehiko Ide, Tosu, Japan

[73] Assignee: Matsushita Electric Industrial Co., Ltd., Osaka, Japan

[21] Appl. No.: 652,353

[22] Filed: Feb. 6, 1991

Related U.S. Application Data

[63] Continuation of Ser. No. 375,419, Jul. 5, 1989, abandoned.

[30] Foreign Application Priority Data

Jul. 12, 1988 [JP] Japan ..... 63-173349

[51] Int. Cl.[5] ..... B41J 35/36

[52] U.S. Cl. ..... 400/249; 400/219; 400/703; 400/239

[58] Field of Search ..... 400/208, 208.1, 219, 400/239, 241, 249, 703, 711, 219.1, 219.3, 238

[56] References Cited

U.S. PATENT DOCUMENTS

| | | | |
|---|---|---|---|
| 3,901,986 | 8/1975 | Brockett et al. | 400/241.2 |
| 4,115,013 | 9/1979 | Hedstrom | 400/208 X |
| 4,146,338 | 3/1979 | Hedstrom | 400/208 X |
| 4,321,286 | 3/1982 | Scott et al. | 400/241.2 X |
| 4,401,394 | 8/1983 | Hume et al. | 400/208 |
| 4,492,483 | 1/1985 | Guillaume | 400/208 |
| 4,612,446 | 9/1986 | Suzuki | 400/249 X |
| 4,636,097 | 1/1987 | Goubeaux | 400/249 X |

FOREIGN PATENT DOCUMENTS

| | | | |
|---|---|---|---|
| 0031284 | 2/1986 | Japan | 400/703 |
| 0229586 | 10/1986 | Japan | 400/249 |
| 1038262 | 8/1983 | U.S.S.R. | 400/241 |

OTHER PUBLICATIONS

IBM Tech. Discl. Bulletin, Feb. 1981, Bullock.

*Primary Examiner*—Edgar S. Burr
*Assistant Examiner*—John S. Hilten
*Attorney, Agent, or Firm*—Stevens, Davis, Miller & Mosher

[57] ABSTRACT

A printing device including a mounting base on which a ribbon cassette accommodating a ribbon having a transparent terminal end part is removably loaded, light emitting and receiving elements fixed on the mounting base and a reflective plate fixed on the mounting base, wherein when the ribbon in the ribbon cassette loaded on the mounting base comes to the end, light emitted from the light emitting element impinges upon and reflects back from the reflective plate through the transparent terminal end part of the ribbon interposed between the light emitting element and the reflective plate and then enters into the light receiving element.

4 Claims, 3 Drawing Sheets

PRINTING DEVICE HAVING A RIBBON CASSETTE WITH A END OF RIBBON SENSOR

This application is a continuation of application Ser. No. 375,419, filed Jul. 5, 1989, now abandoned.

DETAILED DESCRIPTION OF THE INVENTION

The present invention relates to a printing device with a terminal ribbon end sensor which is used in electronic typewriters, word-processor, and the like.

STATEMENT OF THE RELATED ART

Conventionally, in printing devices for use in electronic typewriters, word-processors, and the like, an ink ribbon which is usable only one time and which is called "one time ribbon", is used. Such one time ribbon is held in the form of a spool having a ribbon wound around a core shaft thereof, and, as it is used, the ribbon is taken up onto another core shaft. These printing devices function to read sentences stored in a memory device and to automatically perform printing operation therefor. However, as the amount of stored sentences increases, the letters which must be printed during one unit of printing operations increase in number. As a result, there have recently been not a few cases where the one time ribbon is used up or exhausted during one unit of printing operations. Under the above mentioned circumstances, a terminal ribbon-end sensor for detecting a terminal end of the one time ribbon has recently been employed for printing devices.

A conventional terminal ribbon-end sensor will hereinafter be described.

Referring to FIG. 6 which is a plan view of an essential part of a conventional printing device, a reference numeral 1 denotes a ribbon cassette case which is held in place on a carriage (not shown) and which is formed with an opening 1*a*. Numeral 2 denotes a supply core shaft, and numeral 3 denotes a ribbon on a terminal end portion of which there is adhered a reflective sheet 3*a* made of aluminum foil. Numeral 4 denotes a guide roller while numeral 5 a take-up core shaft. The ribbon 3 is held in place in a state wherein it is wound around the supply core shaft 2 in advance (hereinafter referred to as "supply roll", and, as it is used, the ribbon 3 is taken up onto the take-up core shaft 5. Numeral 6 denotes a reflection type photosensor which is fixed to the carriage and which includes a light emitting element (not shown) and a light receiving element (not shown). When the ribbon cassette case 1 is loaded, the reflection type photosensor enters into the cassette case 1 through the opening 1*a* so as to be located in opposed relation to the ribbon 3.

The operation of the above-constructed conventional terminal ribbon-end sensor will now be described.

As regards the portion of the ribbon 3 except for the terminal end portion thereof, the light outputted from the light emitting element is absorbed by the ribbon so that the light does not have an intensity exceeding a detection level of the light receiving element and thus the element does not detect the light.

On use of the ribbon 3, the take-up thereof onto the core shaft 5 proceeds and thus the reflective sheet 3*a* finally comes to face the photosensor in front thereof, light which has been outputted from the light emitting element being reflected from the reflective sheet 3*a*. This reflected light having an intensity less than the above-mentioned detection level enters the light receiving element, so that the output level thereof increases. Thus, the terminal end portion of the ribbon 3 is detected.

With such arrangement, however, the terminal end portion of the ribbon becomes thicker than the other portion thereof due to an increased thickness of the ribbon attached with the reflective sheet 3*a*. For this reason, when winding the ribbon 3 around the supply core shaft 2, a uniform winding thereof becomes impossible. That is, variations occur in the wound arrangement of the ribbon. In consequence, the contact between adjacent portions of the ribbon is caused under a locally increased pressure. This results in that the ink on the outside surface of such ribbon portion is transferred onto the inside surface of the superposed ribbon portion. This raises a problem that the printed letters become fragmentarily omitted.

On the other hand, with the above-described conventional arrangement, when the ribbon cassette case 1 is not loaded (hereinafter abbreviated as "ribbon-out"), the light emitted from the light emitting element does not enter the photosensor 6. Consequently, the photosensor 6 generates a signal indicating that the ribbon is not at the terminal end thereof. This poses a problem in that, in case of "ribbon-out", the printing operation is erroneously carried out in a state wherein no ribbon exists in position. For this reason, there arises another problem that a "ribbon-out" sensor must be additionally provided.

The present invention is arranged such that a reflective plate as well as a detecting means having a light emitting element and a light receiving element is fixedly provided on a mounting base, the reflective plate and the detecting means being disposed in such a manner that both oppose each other.

With such arrangement, a transparent portion is formed on the ribbon by removing a part of the ink layer thereof. By so doing, the difference in thickness between the transparent portion and the remaining portion of the ribbon can be made smaller than in the case of adhering the reflective aluminum foil sheet. Besides, the same signal is outputted both in the case where a terminal ribbon end has reached and in the case where the ribbon cassette case is not loaded (ribbon-out), so that the detecting means is able to serve concurrently both as the terminal end sensor and as the ribbon-out sensor.

DESCRIPTION OF THE PREFERRED EMBODIMENTS

Figure 1:
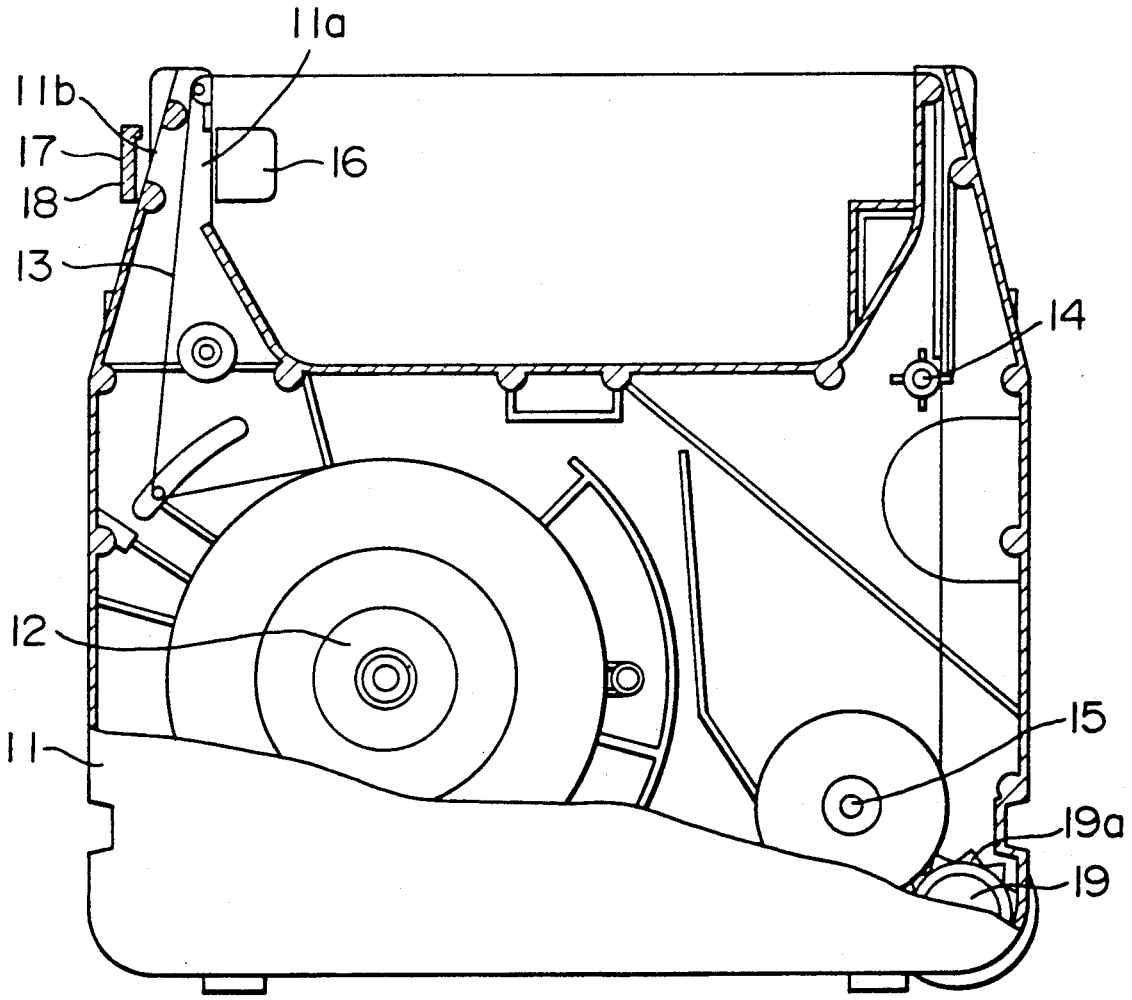
FIG. 1 is a plan view of an essential portion of a printing device according to an embodiment of the present invention.
Figure 3:
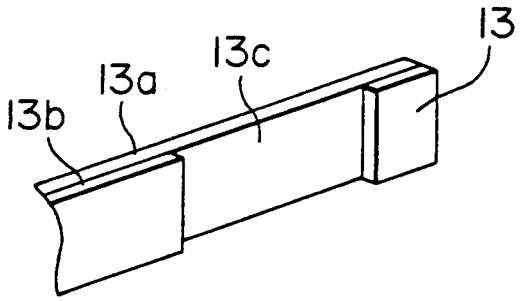
FIG. 3 is a perspective view of an essential portion thereof.
Figure 4:
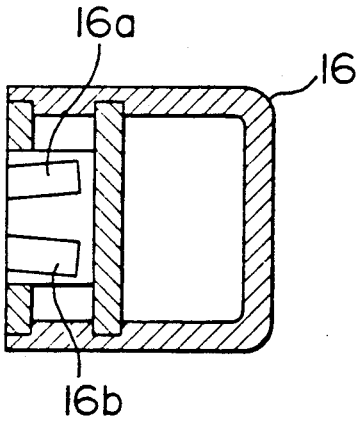
FIG. 4 is a sectional view of an essential portion thereof.

Referring now to FIG. 1 which is a plan view illustrating an essential portion of a printing device in accordance with an embodiment of the present invention, a reference numeral 11 denotes a ribbon cassette case integrally incorporated with a take-up side hollow arm position 15*a* and a supply-side hollow arm portion 12*a* having both side surfaces which are respectively formed with openings 11*a* and 11*b* that are aligned substantially with each other as shown in FIG. 1, numeral 12 denotes a supply core shaft, and numeral 13 denotes a ribbon which includes a base film 13*a* and an ink layer 13*b* thereon as shown in FIG. 3. The ribbon 13 has at its terminal end portion a transparent portion 13*c* formed by removing a part of the ink layer 13*b*. Numeral 14 denotes a guide roller while numeral 15 a take-up core shaft. As in the prior art, the ribbon 13 is held in place in a state wherein it is wound around the supply core shaft 12 in advance. Upon use or printing operation, the ribbon 13 is taken up onto the take-up core shaft 15 from supply core shaft 12 through hollow arm portions 12*a*, 15*a*. Numeral 16, as shown in FIG. 4, denotes a reflection type photosensor which includes a light emitting element 16*a* and a light receiving element 16*b*. The photosensor 16, at the time of loading the ribbon cassette case 11, is caused to oppose the opening 11*a*. Numeral 17 denotes a reflective plate base and numeral 18 denotes a reflective seal which is adhered onto the reflective plate base 17. At the time of loading the ribbon cassette case 11, the reflective seal 18 is allowed to oppose the opening 11*b*. Both when the ribbon cassette case 11 does not exist between the photosensor 16 and the reflective seal 18 and when the transparent portion 13*c* of the terminal ribbon end portion is located between the photosensor 16 and the reflective seal 18, the light outputted from the photosensor 16 is reflected upon the reflective seal 18 and back to the photosensor. Note that numeral 19 denotes a drive roller equipped, on its outer periphery, with drive teeth 19*a*.

Figure 2:
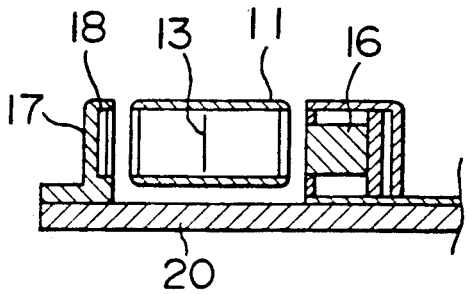
FIG. 2 is a sectional view thereof.

FIG. 2 is a sectional view of the terminal ribbon end sensor according to this embodiment. A reference numeral 20 denotes a carriage on which is loaded a printing means (not shown). On this carriage are fixed the photosensor 16 and the reflective plate base 17. Further, the ribbon cassette case 11 is removably loaded on the carriage.

Figure 5:
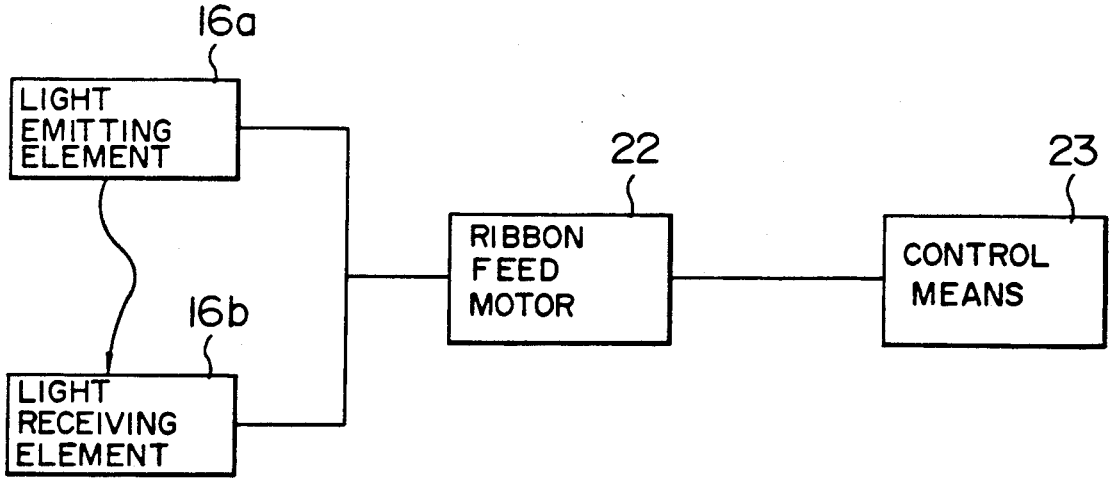
FIG. 5 is a block circuit diagram of the printing device shown in FIG. 1.
Figure 6:
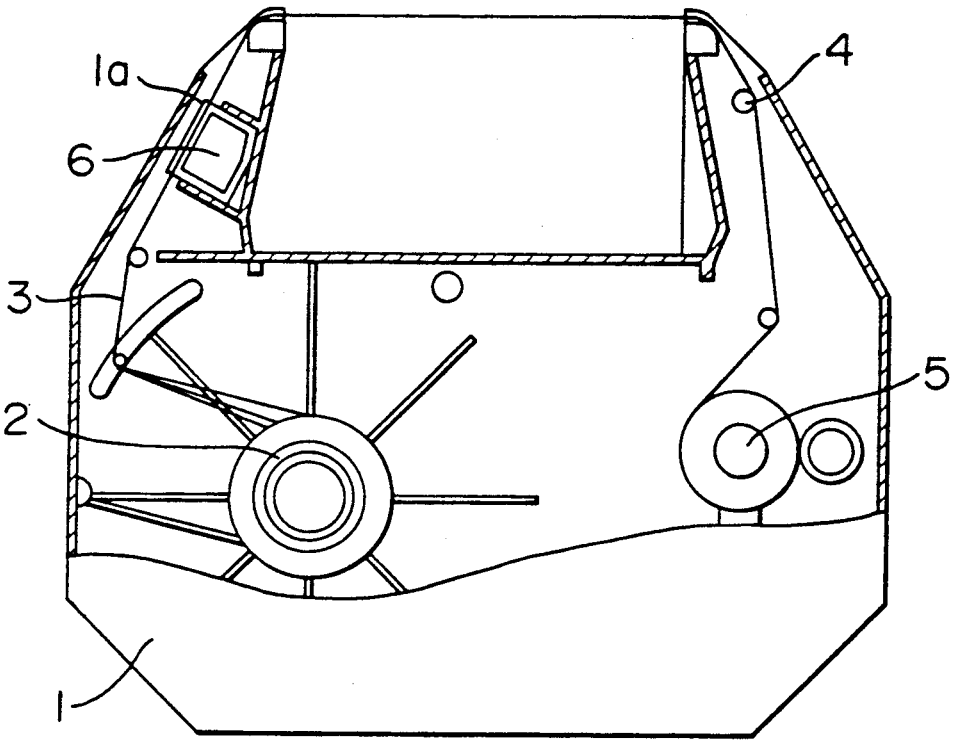
FIG. 6 is a plan view of an essential portion of a conventional printing device.
Figure 7:
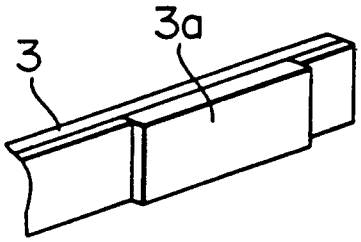
FIG. 7 is a perspective view of an essential portion thereof.

FIG. 5 is a block circuit diagram of the terminal ribbon sensor according to this embodiment. In FIG. 5, a reference numeral 23 denotes a control means while 22 denotes a ribbon feed motor for causing the drive roller 19 to be driven to rotate.

The operation of the above-constructed printing device in accordance with this embodiment will be described below.

During travel of the ink layer 13*b* of the ribbon 13 in front of the photosensor 16, the light outputted from the light emitting element 16*a* is absorbed by the ink layer 13*b*, so that the light receiving element 16*b* does not detect the light.

When the ribbon 13 is taken up onto the take-up core shaft 15, upon use thereof, resulting in that the transparent portion 13*c* reaches the position in front of the photosensor 16, the light outputted from the light emitting element 16*a* passes through the transparent portion 13*c* of the ribbon 13 and then is reflected by the reflective seal 18. Thereafter, the light again passes through the transparent portion 13*c* to enter the light receiving element 16*b*. In consequence, the output level of the light receiving element 16*b* rises and the control means 21 detects this increased level of output so as to stop the rotation of the motor 22 and the performance of the printing operation. This stoppage is indicated by a display means (not shown).

When the ribbon cassette case 11 is not loaded on the carriage 20, there exists no substance to intercept the light between the photosensor 16 and the reflective seal 19. Therefore, the light outputted from the light emitting element 16*a* is reflected by the reflective seal 18 to enter the light receiving element 16*b* In consequence, the output level of the light receiving element increases. This increase in output level is detected by the control means 23 to stop the rotation of the ribbon feed motor 22. As a result, the printing operation also is stopped. Thus, the same display as in the case of detecting the terminal ribbon end portion is made by the display means.

In the above-described embodiment, the terminal ribbon end sensor has been constructed so that the same display may be made both in the case where the terminal end portion of the ribbon has been detected and in the case where the ribbon is not in position, that is, the device is in the state of "ribbon-out". According to the present invention, however, it is possible to differentiate the display between two cases. Namely, in the case where a signal is outputted during the rotation of the ribbon feed motor, display is made of the termination of the ribbon. On the other hand, in the case where a signal is outputted during the non-rotation of the ribbon feed motor, another display is made as a state of "ribbon-out".

In the present invention, the detecting means having the light emitting means and light receiving means, and the reflective plate, are fixed on the loading base or carriage and are disposed in such a manner as to oppose each other with a ribbon interposed therebetween. In addition, a part of the ink layer applied onto the ribbon tape is removed to provide a transparent portion. This makes it possible to make the difference in thickness between the transparent portion and the other portion of the ribbon smaller than in the case of adhering a reflective sheet of aluminum foil on the ribbon. Therefore, no variation occurs in the wound arrangement of the ribbon. In addition, since the same signal is outputted both in the case where the terminal end portion is reached and in the case where the device is in the state of "ribbon-out", one detecting means can concurrently serve both as the terminal end sensor and the ribbon-out sensor.

What is claimed is:

1. A printing device comprising:

a ribbon cassette comprising a cassette case having an inside and an outside, a ribbon disposed in said cassette case and having a transparent portion at its terminal end, said cassette case being integrally incorporated with a supply side hollow arm portion and a take-up side hollow arm portion one of which has side surfaces respectively including openings which face each other and which are spaced apart to provide a space therebetween, said inside of said cassette case being open to the outside through one of said openings, said ribbon extending through said space between said openings and through said hollow arm portions;

a mounting base on which said ribbon cassette is removably mounted;

a detecting means for detecting said transparent portion and including a light emitting means and a light receiving means, said detecting means being mounted on said mounting base;

a reflecting plate mounted on said mounting base and facing said detecting means, said reflecting plate and said detecting means being spaced apart to include said space therebetween, said openings being disposed opposite said detecting means and said reflecting plate, respectively, such that said ribbon extends between said detecting means and said reflecting plate when said ribbon cassette is mounted on said mounting plate.

2. The printing device according to claim 1, wherein said ribbon is a one time ribbon comprising a base film and an ink layer formed thereon.

3. A printing device according to claim 1, wherein said mounting base comprises a ribbon feed motor to drive said ribbon, and a ribbon control means for stopping said ribbon feed motor responsive to said detecting means detecting light reflected from said reflecting plate.

4. A printing device according to claim 3 wherein said control means produces an alarm signal indicating stopping of said ribbon feed motor responsive to said detecting means detecting light reflected from said reflecting plate.

* * * * *